US010794045B2

(12) United States Patent
Muraoka et al.

(10) Patent No.: US 10,794,045 B2
(45) Date of Patent: Oct. 6, 2020

(54) HYDRAULIC DRIVING SYSTEM

(71) Applicant: KAWASAKI JUKOGYO KABUSHIKI KAISHA, Kobe-shi, Hyogo (JP)

(72) Inventors: Hideyasu Muraoka, Akashi (JP); Tomomichi Nose, Akashi (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 16/608,996

(22) PCT Filed: Apr. 27, 2018

(86) PCT No.: PCT/JP2018/017197
§ 371 (c)(1),
(2) Date: Oct. 28, 2019

(87) PCT Pub. No.: WO2018/199290
PCT Pub. Date: Nov. 1, 2018

(65) Prior Publication Data

US 2020/0141089 A1 May 7, 2020

(30) Foreign Application Priority Data

Apr. 28, 2017 (JP) ..... 2017-089432

(51) Int. Cl.
*E02F 9/22* (2006.01)

(52) U.S. Cl.
CPC ..... *E02F 9/2296* (2013.01); *E02F 9/2285* (2013.01); *E02F 9/2235* (2013.01);
(Continued)

(58) Field of Classification Search
CPC .. F15B 2211/20515; F15B 2211/20546; F15B 2211/6316; F15B 19/00;
(Continued)

(56) References Cited

U.S. PATENT DOCUMENTS 5,537,819 A * 7/1996 Kobayashi ..... E02F 9/2228 60/459
6,209,321 B1 * 4/2001 Ikari ..... E02F 9/2228 60/422

(Continued)

FOREIGN PATENT DOCUMENTS

JP 2014-227949 A 12/2014
JP 2017057926 A * 3/2017

*Primary Examiner* — Thomas E Lazo
(74) *Attorney, Agent, or Firm* — Oliff PLC

(57) ABSTRACT

A hydraulic driving system includes a flow control valve device, a bleed-off valve device, a discharge pressure sensor, a relief valve, an operating element, and a controller. The controller executes calibration in which: in a state where the bleed-off valve device blocks between a hydraulic pump and a tank, the controller changes a movement command current supplied to the flow control valve device and makes the discharge pressure sensor detect a discharge pressure; the controller detects at least one of an opening start current that is a current when the flow control valve device starts opening and a closing completion current that is a current when closing of the flow control valve device is completed; and based on the detected at least one current, the controller adjusts a correspondence relation between an operation amount of the operating element and the at least one current.

9 Claims, 5 Drawing Sheets

(52) U.S. Cl.
CPC ... *E02F 9/2267* (2013.01); *F15B 2211/20515* (2013.01); *F15B 2211/20546* (2013.01); *F15B 2211/6316* (2013.01)

(58) Field of Classification Search
CPC ..... E02F 9/2296; E02F 9/2285; E02F 9/2235; E02F 9/2267; E02F 9/20
See application file for complete search history.

(56) References Cited

U.S. PATENT DOCUMENTS

| | | | | |
|---|---|---|---|---|
| 7,284,371 | B2 * | 10/2007 | Toji | E02F 9/2235 60/445 |
| 7,878,770 | B2 * | 2/2011 | Oka | E02F 9/2296 417/278 |
| 2014/0196448 | A1 * | 7/2014 | Matsuzaki | E02F 3/32 60/459 |
| 2014/0196793 | A1 * | 7/2014 | Matsuzaki | E02F 9/2228 137/1 |
| 2017/0009428 | A1 * | 1/2017 | Hijikata | F15B 13/06 |

* cited by examiner

HYDRAULIC DRIVING SYSTEM

TECHNICAL FIELD

The present invention relates to a hydraulic driving system configured to supply an operating liquid, discharged from a hydraulic pump, to a hydraulic actuator to drive the hydraulic actuator.

BACKGROUND ART

Work machines, such as hydraulic excavators, capable of travelling include hydraulic actuators (such as hydraulic cylinders and hydraulic motors) to move booms, arms, buckets, turning bodies, and the like. The hydraulic actuator is driven by an operating liquid supplied from the hydraulic driving system. The hydraulic driving system changes the flow direction and flow rate of the operating liquid to control the moving direction and speed of the hydraulic actuator. Known as the hydraulic driving system configured as above is a hydraulic system (corresponding to a configuration including a device group G1 and a controller) of PTL 1, for example.

The hydraulic system of PTL 1 includes a flow control valve (actuator control valve in PTL 1), a bleed-off valve (unloading valve in PTL 1), and a controller. The flow control valve is provided with a pair of electromagnetic valves. In accordance with pilot pressures output from the pair of electromagnetic valves, the flow control valve controls the flow rate of the operating liquid supplied to the hydraulic actuator. Further, the bleed-off valve is also provided with an electromagnetic valve. In accordance with a pilot pressure output from the electromagnetic valve, the bleed-off valve performs bleed-off of the operating liquid to control the flow rate of the operating liquid supplied to the hydraulic actuator. The three electromagnetic valves are connected to the controller. The controller supplies command currents, corresponding to the operation direction and operation amount of an operating lever, to the electromagnetic valves to control the movements of the electromagnetic valves.

CITATION LIST

Patent Literature

PTL 1: Japanese Laid-Open Patent Application Publication No. 2014-227949

SUMMARY OF INVENTION

Technical Problem

As described above, based on a command from the controller, the hydraulic system of PTL 1 supplies the command currents, corresponding to the operation of the operating lever, to the electromagnetic valves to operate the electromagnetic valves. However, a movement start timing and movement completion timing of each electromagnetic valve with respect to the supplied command current vary due to manufacturing errors and the like. To be specific, each timing of the valve with respect to the operation amount of the operating lever varies. To solve this problem, it is desirable to perform calibration of the command current supplied to the electromagnetic valve in accordance with the operation amount of the operating lever.

As one example of a method of performing the calibration, a pressure sensor is attached to an output side of the electromagnetic valve and measures the characteristics of an output pressure of the electromagnetic valve with respect to the command current, and the command current is adjusted such that variation of the characteristics is reduced. However, according to this method, although the relation between the output pressure of the electromagnetic valve and the command current can be adjusted, the movement start timing and movement completion timing of the valve with respect to the command current cannot be adjusted. It should be noted that among the above electromagnetic valves, there is a valve incorporated in the flow control valve or the bleed-off valve. In this case, it is difficult to attach the pressure sensor. Therefore, there exists a method below.

To be specific, there is a method in which: pressure sensors are attached to an output side of the flow control valve and an output side of the bleed-off valve; the relation between the output pressure of the flow control valve and the command current and the relation between the output pressure of the bleed-off valve and the command current are detected; and based on the detected relations, the calibration of the command currents to be supplied with respect to the operation amount of the operating lever is performed. However, in the hydraulic driving system, the need for attaching the pressure sensors to the output side of the flow control valve and the output side of the bleed-off valve is low, and these pressure sensors may be attached only when the calibration is performed. Further, to attach these pressure sensors, pipes need to be additionally formed, installed, or removed. Thus, many man-hours are required for the calibration.

An object of the present invention is to provide a hydraulic system capable of adjusting an movement start timing or movement completion timing of a valve device (i.e., a flow control valve device and a bleed-off valve device) with respect to an operation of an operating lever without providing a pressure sensor at an output side of the valve device.

Solution to Problem

A hydraulic driving system of the present invention includes: a flow control valve device interposed between a hydraulic pump and a hydraulic actuator configured to be driven by an operating liquid discharged from the hydraulic pump, the flow control valve device being configured to adjust an opening degree between the hydraulic pump and the hydraulic actuator in accordance with a movement command current to control a flow rate of the operating liquid discharged from the hydraulic pump, the movement command current being supplied to the flow control valve device; a bleed-off valve device interposed between the hydraulic pump and a tank and configured to adjust an opening degree between the hydraulic pump and the tank to control the flow rate at which bleed-off of the operating liquid is performed; a discharge pressure sensor configured to detect a discharge pressure of the hydraulic pump; a relief valve configured to, when the discharge pressure of the hydraulic pump becomes a relief pressure or more, exhaust to the tank the operating liquid discharged from the hydraulic pump; an operating element configured to be operated for driving the hydraulic actuator; and a controller configured to control a movement of the flow control valve device by supplying to the flow control valve device the movement command current corresponding to an operation amount of the operating element and also configured to control a movement of the bleed-off valve device. The controller executes calibration in which: in a state where the bleed-off valve device blocks between the hydraulic pump and the tank, the controller changes the movement command current supplied to the flow control valve device and makes the discharge pressure sensor detect the discharge pressure; based on the detected discharge pressure and the relief pressure, the controller detects at least one of an opening start current that is a current when the flow control valve device starts opening and a closing completion current that is a current when closing of the flow control valve device is completed; and based on the detected at least one current, the controller adjusts a correspondence relation between the operation amount of the operating element and the at least one current.

According to the present invention, at least one of the correspondence relation between the operation amount of the operating lever and the opening start current and the correspondence relation between the operation amount of the operating lever and the closing completion current can be adjusted by performing the calibration. To be specific, in the hydraulic driving system, at least one of the movement start timing of the flow control valve device with respect to the operation of the operating lever and the movement completion timing of the flow control valve device with respect to the operation of the operating lever can be adjusted without providing the pressure sensor at the output side of the flow control valve device.

In the above invention, when changing the movement command current supplied to the flow control valve device to detect the opening start current in the calibration, the controller may make the flow control valve device block between the hydraulic pump and the hydraulic actuator, and then, change the movement command current so as to open between the hydraulic pump and the hydraulic actuator.

According to the above configuration, the discharge pressure steeply decreases when the flow control valve device opens between the hydraulic pump and the hydraulic actuator. Therefore, whether or not the flow control valve device is open is easily determined in the calibration. Thus, the detected opening start currents can be prevented from varying.

In the above invention, the controller may control a displacement of a variable displacement pump that is the hydraulic pump, and in the calibration, the controller may set a discharge flow rate of the hydraulic pump to a predetermined flow rate or less.

According to the above configuration, the discharge flow rate can be made low, and the change in the discharge pressure when opening or closing between the hydraulic pump and the hydraulic actuator can be made steeper than when the discharge flow rate is high. Therefore, the start of the opening of the flow control valve device and the start of the closing of the flow control valve device are easily determined. Thus, the detected opening start currents and the detected closing start currents can be prevented from varying.

In the above invention, before the controller executes the calibration, the controller may supply the operating liquid through the flow control valve device to a hydraulic cylinder, which is the hydraulic actuator, to make a rod of the hydraulic cylinder move to a predetermined position.

According to the above configuration, the correspondence relation is adjusted after the rod of the hydraulic cylinder is made to move to the predetermined position. Therefore, the adjustment of the correspondence relation can be performed at the same position. A load acting on the rod may change depending on the position of the rod, and the load may influence the detection of the current. By performing the calibration in the same posture, such influence can be suppressed, and the detected currents can be prevented from varying.

In the above invention, the controller may control the movement of the flow control valve device to make the rod of the hydraulic cylinder move to a stroke end that is the predetermined position, and in order that the operating liquid flows through the flow control valve device in such a direction that the rod of the hydraulic cylinder moves, the controller changes the movement command current supplied to the flow control valve device.

According to the above configuration, after the rod is made to move to the stroke end before adjusting the correspondence relation, the rod is made to move in an opposite movable direction. Therefore, it is possible to prevent a case where while the calibration is being executed, the rod reaches the stroke end, and therefore, the operating liquid cannot be supplied to the hydraulic cylinder. To be specific, it is possible to prevent a case where the rod reaches the stroke end, and therefore, the opening start current cannot be detected. On this account, the movement start timing of the flow control valve device with respect to the operation of the operating lever can be adjusted without providing a sensor and the like configured to detect the position of the rod.

In the above invention, the hydraulic driving system may further include an instructing device configured to instruct an execution of the calibration Based on the instruction of the execution of the calibration from the instructing device, the controller may execute the calibration.

According to the above configuration, the calibration is executed after the execution of the calibration is instructed. Therefore, the calibration can be prevented from being undesirably performed during, for example, driving.

In the above invention, the controller may execute the calibration including: a first processing in which the controller detects a first opening start current that is the opening start current, and the controller adjusts a correspondence relation between the operation amount of the operating element and the first opening start current; and a second processing in which the controller makes the discharge pressure sensor detect the discharge pressure while changing the bleed-off command current supplied to the bleed-off valve device, based on the detected discharge pressure and the relief pressure, the controller detects a second opening start current that is a current when the bleed-off valve device starts opening, and based on the detected second opening start current, the controller adjusts a correspondence relation between the operation amount of the operating element and the opening start current of the bleed-off valve device.

According to the above configuration, the second opening start current that is the bleed-off command current supplied to the bleed-off valve device when the bleed-off valve starts opening can be detected by performing the calibration. Based on the second opening start current, the correspondence relation between the operation amount of the operating lever and the opening start point of the bleed-off valve device can be adjusted. To be specific, in the hydraulic driving system, the movement start timing of the bleed-off valve device with respect to the operation of the operating lever can be adjusted without providing the pressure sensor at the output side of the bleed-off valve device.

In the above invention, the controller may execute the calibration including: a first processing in which the controller detects a first closing completion current that is the closing completion current, and the controller adjusts a correspondence relation between the operation amount of the operating element and the first closing completion current; and a second processing in which the controller makes the discharge pressure sensor detect the discharge pressure while changing the bleed-off command current supplied to the bleed-off valve device, based on the detected discharge pressure and the relief pressure, the controller detects a second closing completion current that is a current when closing of the bleed-off valve device is completed, and based on the detected second closing completion current, the controller adjusts a correspondence relation between the operation amount of the operating element and the second closing completion current.

According to the above configuration, the second closing completion current that is the bleed-off command current supplied to the bleed-off valve device when the closing of the bleed-off valve is completed can be detected by performing the calibration. Based on the second closing completion current, the correspondence relation between the operation amount of the operating lever and the closing start point of the bleed-off valve device can be adjusted. To be specific, in the hydraulic driving system, the movement completion timing of the bleed-off valve device with respect to the operation of the operating lever can be adjusted without providing the pressure sensor at the output side of the bleed-off valve device.

A hydraulic driving system of the present invention includes: a bleed-off valve device interposed between a tank and a hydraulic pump configured to supply an operating liquid to a hydraulic actuator, the bleed-off valve device being configured to adjust an opening degree between the hydraulic pump and the tank in accordance with a bleed-off command current to control a flow rate at which bleed-off of the operating liquid discharged from the hydraulic pump is performed, the bleed-off command current being supplied to the bleed-off valve device; a discharge pressure sensor configured to detect a discharge pressure of the hydraulic pump; a relief valve configured to, when the discharge pressure of the hydraulic pump becomes a relief pressure or more, exhaust to the tank the operating liquid discharged from the hydraulic pump; an operating element configured to be operated for driving the hydraulic actuator; and a controller configured to control a movement of the bleed-off valve device by supplying to the bleed-off valve device the bleed-off command current corresponding to an operation amount of the operating element. The controller executes calibration in which: the controller makes the discharge pressure sensor detect the discharge pressure while changing the bleed-off command current supplied to the bleed-off valve device; based on the detected discharge pressure and the relief pressure, the controller detects at least one of an opening start current that is a current when the bleed-off valve device starts opening and a closing completion current that is a current when closing of the bleed-off valve device is completed; and based on the detected at least one current, the controller adjusts a correspondence relation between the operation amount of the operating element and the at least one current.

According to the present invention, at least one of the correspondence relation between the operation amount of the operating lever and the opening start current and the correspondence relation between the operation amount of the operating lever and the closing completion current can be adjusted by performing the calibration. To be specific, in the hydraulic driving system, at least one of the movement start timing of the bleed-off valve device with respect to the operation of the operating lever and the movement completion timing of the bleed-off valve device with respect to the operation of the operating lever can be adjusted without providing the pressure sensor at the output side of the bleed-off valve device.

Advantageous Effects of Invention

According to the present invention, the movement start timing or movement completion timing of the valve device with respect to the operation of the operating lever can be adjusted without providing a pressure sensor at an output side of the valve device.

DESCRIPTION OF EMBODIMENTS

Hereinafter, a hydraulic driving system 1 according to Embodiment 1 of the present invention, a hydraulic driving system 1A according to Embodiment 2 of the present invention, and a hydraulic excavator 2 including the hydraulic driving system will be described with reference to the drawings. Directions used in the following description are described based on directions corresponding to the view of a driver who is in the hydraulic excavator 2. However, these directions are used for convenience sake, and the directions and the like of components of the present invention are not limited. Further, each of the hydraulic driving systems 1 and 1A described below is just one embodiment of the present invention. Therefore, the present invention is not limited to the embodiments, and additions, deletions, and modifications may be made within the scope of the present invention.

Embodiment 1

A work machine is capable of travelling and is configured to be able to perform various work, such as excavation and lifting, at a site where the work machine has travelled and reached. The work machine includes an attachment for performing the various work and further includes a plurality of actuators for operating the attachment. Examples of the work machine include a hydraulic crane, a wheel loader, and the hydraulic excavator 2. The following will explain the hydraulic excavator 2 as one example of the work machine.

Hydraulic Excavator

Figure 1:
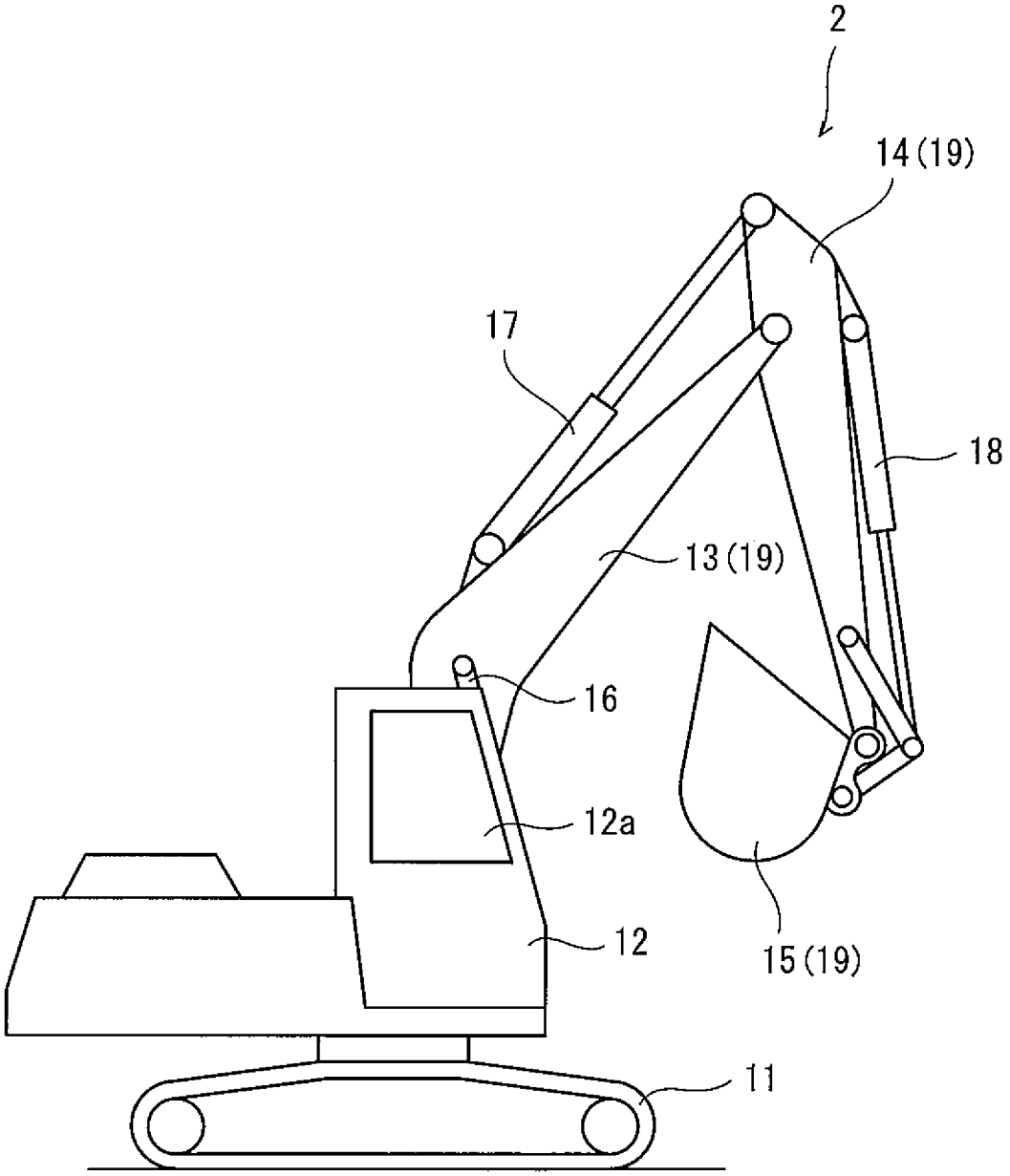
FIG. 1 is a side view showing a hydraulic excavator including a hydraulic driving system according to Embodiment 1 or 2 of the present invention.

The hydraulic excavator 2 shown in FIG. 1 is capable of travelling and moving and moves a bucket 15 to perform work, such as excavation and carrying. To be specific, the hydraulic excavator 2 includes a travelling device 11, a turning body 12, a boom 13, an arm 14, and the bucket 15. The travelling device 11 is, for example, a crawler and is capable of travelling by a travelling motor (not shown). The turning body 12 is mounted on the travelling device 11 so as to be turnable. The turning body 12 is capable of turning by a turning motor (not shown). A driver's cab 12*a* is formed at the turning body 12. A driver who operates the hydraulic excavator 2 can get on the driver's cab 12*a*, and below-described operating devices 41 to 43 and the like are arranged in the driver's cab 12*a*. Further, the boom 13 is provided at the turning body 12.

A base end portion of the boom 13 is provided at the turning body 12, and the boom 13 is swingable in an upper-lower direction. The boom 13 extends from the turning body 12 in an obliquely upward and front direction. The arm 14 is provided at a tip end portion of the boom 13 so as to be swingable in a front-rear direction. The arm 14 extends from the boom 13 in an obliquely downward and front direction. The bucket 15 is provided at a tip end portion of the arm 14 so as to be rotatable in the front-rear direction. Hydraulic cylinders 16 to 18 are respectively provided at the boom 13, the arm 14, and the bucket 15 so as to respectively operate the boom 13, the arm 14, and the bucket 15.

More specifically, the hydraulic excavator 2 includes a pair of boom cylinders 16, an arm cylinder 17, and a bucket cylinder 18. The pair of boom cylinders 16 (in FIGS. 1 and 2, only one of the boom cylinders 16 is shown) are arranged at respective left and right sides of the boom 13 so as to sandwich the boom 13. The boom cylinders 16 extend between the boom 13 and the turning body 12. The boom cylinders 16 arranged as above expand and contract in accordance with the supply of an operating liquid. By the expansion and contraction of the boom cylinders 16, the boom 13 swings in the upper-lower direction. The arm cylinder 17 extends between the boom 13 and the arm 14, and the bucket cylinder 18 extends between the arm 14 and the bucket 15. The arm cylinder 17 and the bucket cylinder 18 also expand and contract in accordance with the supply of the operating liquid. By the expansion and contraction of the arm cylinder 17 and the bucket cylinder 18, the arm 14 and the bucket 15 swing in the front-rear direction.

Figure 2:
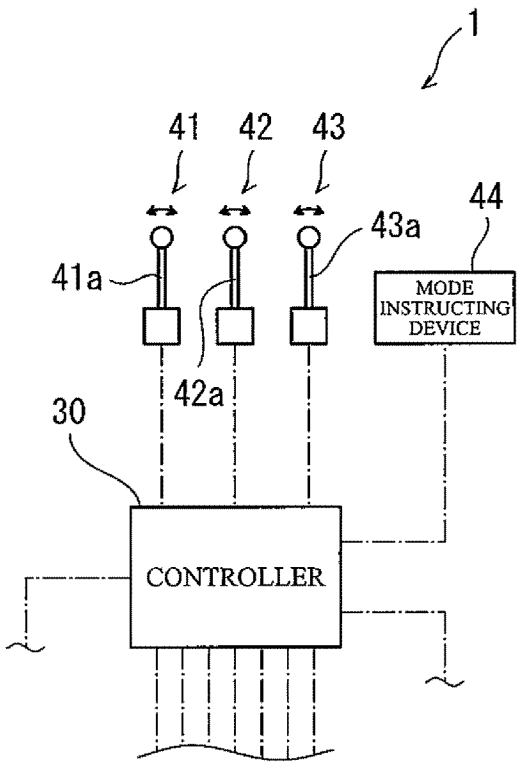
FIG. 2 is a circuit diagram showing a hydraulic circuit of the hydraulic driving system according to Embodiment 1.
Figure 2:
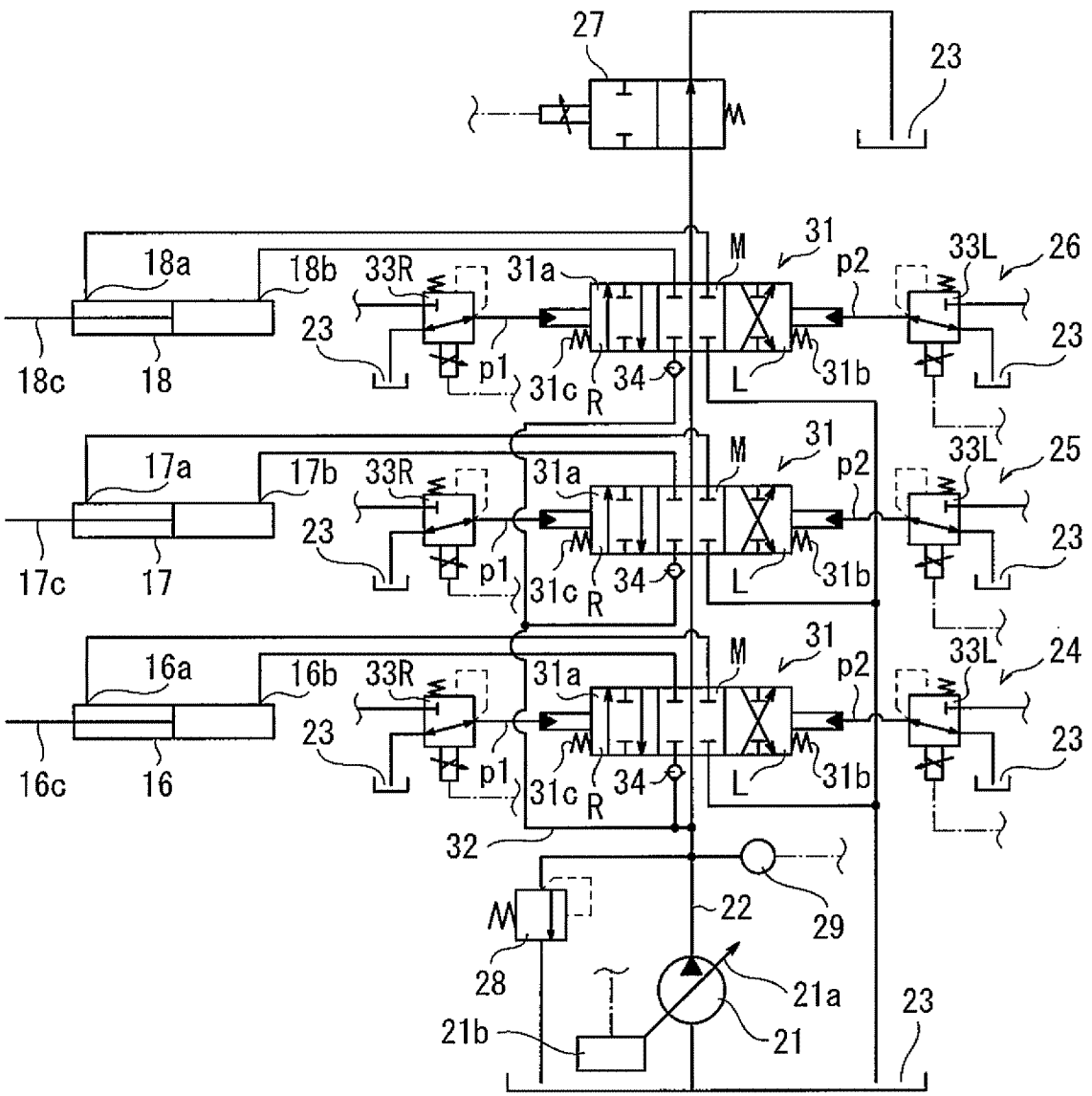

As shown in FIG. 2, the hydraulic cylinder 16 includes a rod port 16*a* and a head port 16*b*. The hydraulic cylinder 17 includes a rod port 17*a* and a head port 17*b*, and the hydraulic cylinder 18 includes a rod port 18*a* and a head port 18*b*. When the operating liquid is supplied to the rod port (16*a*, 17*a*, 18*a*), and the operating liquid is exhausted from the head port (16*b*, 17*b*, 18*b*), the cylinder (16, 17, 18) contracts. When the operating liquid is supplied to the head port (16*b*, 17*b*, 18*b*), and the operating liquid is exhausted from the rod port (16*a*, 17*a*, 18*a*), the cylinder (16, 17, 18) expands. To supply the operating liquid to the cylinders 16 to 18 configured to expand and contract as above and discharge the operating liquid from the cylinders 16 to 18, the hydraulic excavator 2 includes the hydraulic driving system 1.

Hydraulic Driving System

The hydraulic driving system 1 is a system configured to supply the operating liquid to the cylinders 16 to 18 to drive the cylinders 16 to 18. The hydraulic driving system 1 is constituted by a center bleed type hydraulic control circuit and includes a hydraulic pump 21. The hydraulic pump 21 is coupled to a driving source (not shown), such as an engine, and is rotated by the driving source to discharge the operating liquid (liquid, such as water or oil). The hydraulic pump 21 having such function is, for example, a variable displacement swash plate pump and can change a discharge flow rate. To be specific, the hydraulic pump 21 includes a swash plate 21*a*. By changing a tilting angle of the swash plate 21*a*, the hydraulic pump 21 discharges the operating liquid at the flow rate corresponding to the tilting angle. The swash plate 21*a* is provided with a regulator 21*b*. The regulator 21*b* changes the tilting angle of the swash plate 21*a* in accordance with a command input to the regulator 21*b*. The hydraulic pump 21 configured as above is connected to a main passage 22. The hydraulic pump 21 suctions the operating liquid from a tank 23 and discharges the operating liquid to the main passage 22. Further, three flow control valve devices 24 to 26 are interposed on the main passage 22.

The three flow control valve devices 24, 25, and 26 are provided so as to respectively correspond to the cylinders 16, 17, and 18. The flow control valve device (24, 25, 26) controls the direction and flow rate of the operating liquid supplied to the corresponding cylinder (16, 17, 18). To be specific, the hydraulic driving system 1 includes a boom flow control valve device 24, an arm flow control valve device 25, and a bucket flow control valve device 26. The boom flow control valve device 24 corresponds to the pair of boom cylinders 16. The arm flow control valve device 25 corresponds to the arm cylinder 17. The bucket flow control valve device 26 corresponds to the bucket cylinder 18. In the present embodiment, the three flow control valve devices 24 to 26 are interposed on the main passage 22 in order of the boom flow control valve device 24, the arm flow control valve device 25, and the bucket flow control valve device 26, but the order is not limited to this. It should be noted that the three flow control valve devices 24 to 26 has the same function although targets to which the flow control valve devices 24 to 26 supply the operating liquid are different from one another. Therefore, the following will mainly describe the configuration of the boom flow control valve device 24. Regarding the flow control valve devices 25 and 26, the same reference signs are used for their components that are the same as the components of the boom flow control valve device 24, and a repetition of the same explanation is avoided.

Based on a movement command current input to the boom flow control valve device 24, the boom flow control valve device 24 changes a flow direction of the operating liquid discharged from the hydraulic pump 21 and controls the flow rate of the operating liquid supplied to the pair of boom cylinders 16. To be specific, the boom flow control valve device 24 includes a flow control valve 31 and a pair of electromagnetic proportional valves 33R and 33L. The flow control valve 31 is a so-called spool valve including six ports. The flow control valve 31 changes a connection status of each port in accordance with the position of a spool 31*a*. Hereinafter, the configuration of the flow control valve 31 for the boom will be described in detail.

The flow control valve 31 is a center open type spool valve and opens and closes the main passage 22 in accordance with the position of the spool 31*a*. To be specific, when the spool 31*a* is located at a neutral position M, the flow control valve 31 opens the main passage 22, and with this, the operating liquid flows to a downstream side of the flow control valve 31. On the other hand, when the spool 31*a* moves from the neutral position M to a first offset position R or a second offset position L, the flow control valve 31 narrows an opening degree of the main passage 22 in accordance with the position (i.e., a movement distance) of the spool 31*a*. To be specific, the flow control valve 31 supplies the operating liquid to the downstream side of the flow control valve 31 at the flow rate corresponding to the position of the spool 31*a*.

The main passage 22 branches at an upstream side of the flow control valve 31, and a branch supply passage 32 is connected to the flow control valve 31 through a check valve 34. The check valve 34 allows the flow of the operating liquid flowing through the supply passage 32 from the main passage 22 to the flow control valve 31 but blocks the flow of the operating liquid in its opposite direction. The supply passage 32 is connected to one port of the flow control valve 31. The rod port 16*a* and head port 16*b* of the boom cylinder 16 and the tank 23 are connected to other ports of the flow control valve 31.

When the spool 31*a* is located at the neutral position M, four ports of the flow control valve 31 other than two ports to which the main passage 22 is connected are blocked. With this, the supply and discharge of the operating liquid to and from the boom cylinder 16 are stopped, and an expansion/contraction state of the boom cylinder 16 is kept. On the other hand, when the spool 31*a* moves from the neutral position M to the first offset position R, the rod port 16*a* and the tank 23 are connected to each other, and the head port 16*b* and the supply passage 32 are connected to each other. With this, the boom cylinder 16 expands, and therefore, the boom 13 is lifted. Further, when the spool 31*a* moves from the neutral position M to the second offset position L, the head port 16*b* and the tank 23 are connected to each other, and the rod port 16*a* and the supply passage 32 are connected to each other. With this, the boom cylinder 16 contracts, and therefore, the boom 13 is lowered. Further, in the flow control valve 31, an opening degree between the ports connected is adjusted in accordance with the position of the spool 31*a*. To be specific, the opening degree between the port 16*a* and the tank 23, the opening degree between the port 16*b* and the tank 23, the opening degree between the port 16*a* and the supply passage 32, and the opening degree between the port 16*b* and the supply passage 32 are controlled in accordance with the position of the spool 31*a* as with the main passage 22, and therefore, the operating liquid is supplied to and discharged from the boom cylinder 16 at the flow rate corresponding to the position of the spool 31*a*.

In the flow control valve 31 having such function, the spool 31*a* is provided with a pair of springs 31*b* and 31*c*, and the pair of springs 31*b* and 31*c* bias the spool 31*a* in respective directions opposing each other. The spool 31*a* receives two pilot pressures p1 and p2. The first pilot pressure p1 acts on the spool 31*a* against the biasing force of the first spring 31*b*. The second pilot pressure p2 acts on the spool 31*a* against the biasing force of the second spring 31*c*. To be specific, the two pilot pressures p1 and p2 act on the spool 31*a* against each other. The spool 31*a* moves to a position corresponding to a differential pressure between the two pilot pressures p1 and p2. To supply the two pilot pressures p1 and p2 to the spool 31*a*, the flow control valve 31 is provided with the pair of electromagnetic proportional valves 33R and 33L.

The pair of electromagnetic proportional valves 33R and 33L are connected to a pilot pump (not shown) and the tank 23. The electromagnetic proportional valve 33R outputs the pilot pressure p1 corresponding to the movement command current input to the electromagnetic proportional valve 33R, and the electromagnetic proportional valve 33L outputs the pilot pressure p2 corresponding to the movement command current input to the electromagnetic proportional valve 33L. As described above, the pilot pressures p1 and p2 act on the spool 31*a* against each other, and the spool 31*a* moves to a position corresponding to the differential pressure between the two pilot pressures p1 and p2. As above, the spool 31*a* moves to a position corresponding to the movement command current. With this, the operating liquid is supplied to the boom cylinder 16 in the direction corresponding to the movement command current at the flow rate corresponding to the movement command current, and thereby the boom cylinder 16 can move at a speed corresponding to the movement command current.

Each of the arm flow control valve device 25 and the bucket flow control valve device 26 has the same function as the boom flow control valve device although hydraulic actuators as the targets are different from one another. To be specific, each of the arm flow control valve device 25 and the bucket flow control valve device 26 includes the flow control valve 31 and the pair of electromagnetic proportional valves 33R and 33L. In the arm flow control valve device 25, the flow control valve 31 performs the supply and discharge of the operating liquid to and from the two ports 17*a* and 17*b* of the arm cylinder. In the bucket flow control valve device 26, the flow control valve 31 performs the supply and discharge of the operating liquid to and from the two ports 18*a* and 18*b* of the bucket cylinder. Thus, based on the movement command current input to the arm flow control valve device 25, the arm flow control valve device 25 changes the flow direction of the operating liquid discharged from the hydraulic pump 21 and controls the flow rate of the operating liquid supplied to the cylinder 17. Further, based on the movement command current input to the bucket flow control valve device 26, the bucket flow control valve device 26 changes the flow direction of the operating liquid discharged from the hydraulic pump 21 and controls the flow rate of the operating liquid supplied to the cylinder 18. As described above, the boom flow control valve device 24, the arm flow control valve device 25, and the bucket flow control valve device 26 are interposed on the main passage 22 so as to be lined up. In addition to the three valve devices 24 to 26, a bleed-off valve 27 is interposed on the main passage 22 so as to be located downstream of the three valve devices 24 to 26.

The bleed-off valve 27 is a so-called electromagnetic proportional valve. The bleed-off valve 27 opens and closes the main passage 22 in accordance with a bleed-off command current supplied to the bleed-off valve 27. More specifically, the bleed-off valve 27 is a normally-open electromagnetic proportional valve. The bleed-off valve 27 closes the main passage 22 as the bleed command current increases. The main passage 22 is connected to the tank 23 on the downstream side of the bleed-off valve 27. When the bleed-off valve 27 opens the main passage 22, the operating liquid is exhausted to the tank 23, i.e., bleed-off is performed.

In addition to the bleed-off valve 27 and the three flow control valve devices 24 to 26, a relief valve 28 and a discharge pressure sensor 29 are connected to the main passage 22. To be specific, the relief valve 28 is connected to the main passage 22 so as to be located upstream of the boom flow control valve device 24, i.e., located close to the hydraulic pump 21. The relief valve 28 is connected to the main passage 22 and the tank 23. The relief valve 28 opens when a pressure (i.e., a discharge pressure) of the operating liquid flowing through the main passage 22 becomes a predetermined relief pressure pr or more. When the relief valve 28 opens, the operating liquid flowing through the main passage 22 is exhausted to the tank 23. With this, the pressure of the operating liquid flowing through the main passage 22 is prevented from exceeding the relief pressure pr. Further, the discharge pressure sensor 29 is provided on the passage 22 so as to be located upstream of the boom flow control valve device 24. The discharge pressure sensor 29 is electrically connected to a controller 30. The discharge pressure sensor 29 outputs to the controller 30 a signal corresponding to the discharge pressure of the hydraulic pump 21. The controller 30 detects the discharge pressure of the hydraulic pump 21 based on the signal supplied from the discharge pressure sensor 29 and stores the detected discharge pressure.

A plurality of operating devices are electrically connected to the controller 30 (In the present embodiment, for convenience sake, three operating devices 41 to 43 are described below, but, the number of operating devices can be reduced by utilizing an operating device capable of being operated in an x-axis direction and a y-axis direction). To allow the driver to operate the operating devices 41 to 43, the operating devices 41 to 43 are arranged in the driver's cab 12*a*. The operating devices 41 to 43 correspond to the three cylinders 16 to 17, respectively. The operating device (41, 42, 43) supplies a command regarding a moving direction and moving speed of the corresponding hydraulic cylinder (16, 17, 18). More specifically, the operating devices 41 to 43 are, for example, electric joysticks and include respective operating levers 41*a* to 43*a*. Each of the operating levers 41*a* to 43*a* that are operating elements is configured to be able to be operated toward one side and the other side in a predetermined direction. When the operating lever (41*a*, 42*a*, 43*a*) of the operating device (41, 42, 43) is operated, the operating device (41, 42, 43) outputs to the controller 30 a signal corresponding to an operation direction and operation amount of the operating lever (41*a*, 42*a*, 43*a*). The controller 30 is electrically connected to all the electromagnetic proportional valves 33R and 33L of the three flow control valve devices 24 to 26. Based on the signal output from the operating device (41, 42, 43), the controller 30 supplies the movement command current to the electromagnetic proportional valves 33R and 33L of the corresponding flow control valve device (24, 25, 26). When the controller 30 supplies the movement command current, the hydraulic cylinder (16, 17, 18) corresponding to the operated operating lever (41*a*, 42*a*, 43*a*) operates in a direction corresponding to the operation direction at a speed corresponding to the operation amount.

The controller 30 is electrically connected to the regulator 21*b* and the bleed-off valve 27. Based on the signals output from the operating devices 41 to 43 (more specifically, in accordance with the operation amounts of the operating levers 41*a* to 43*a*), the controller 30 outputs a discharge flow rate command signal to the regulator 21*b* and outputs a bleed-off command signal to the bleed-off valve 27. With this, the operating liquid is discharged from the hydraulic pump at the flow rate corresponding to the operation amount of the operating lever (41*a*, 42*a*, 43*a*), and the bleed-off of the operating liquid is performed at the flow rate corresponding to the operation amount of the operating lever (41*a*, 42*a*, 43*a*).

The controller 30 having such function prestores relations between the operation amounts of the operating levers 41*a* to 43*a* and three command currents to be output (i.e., the movement command current, a discharge flow rate command current, and the bleed-off command current). Based on the relations, the controller 30 outputs the command currents. For example, in the present embodiment, the relation between the operation amount and the movement command current is a proportional relation. The controller 30 outputs to each component the movement command current proportional to the operation amount.

Figure 3:
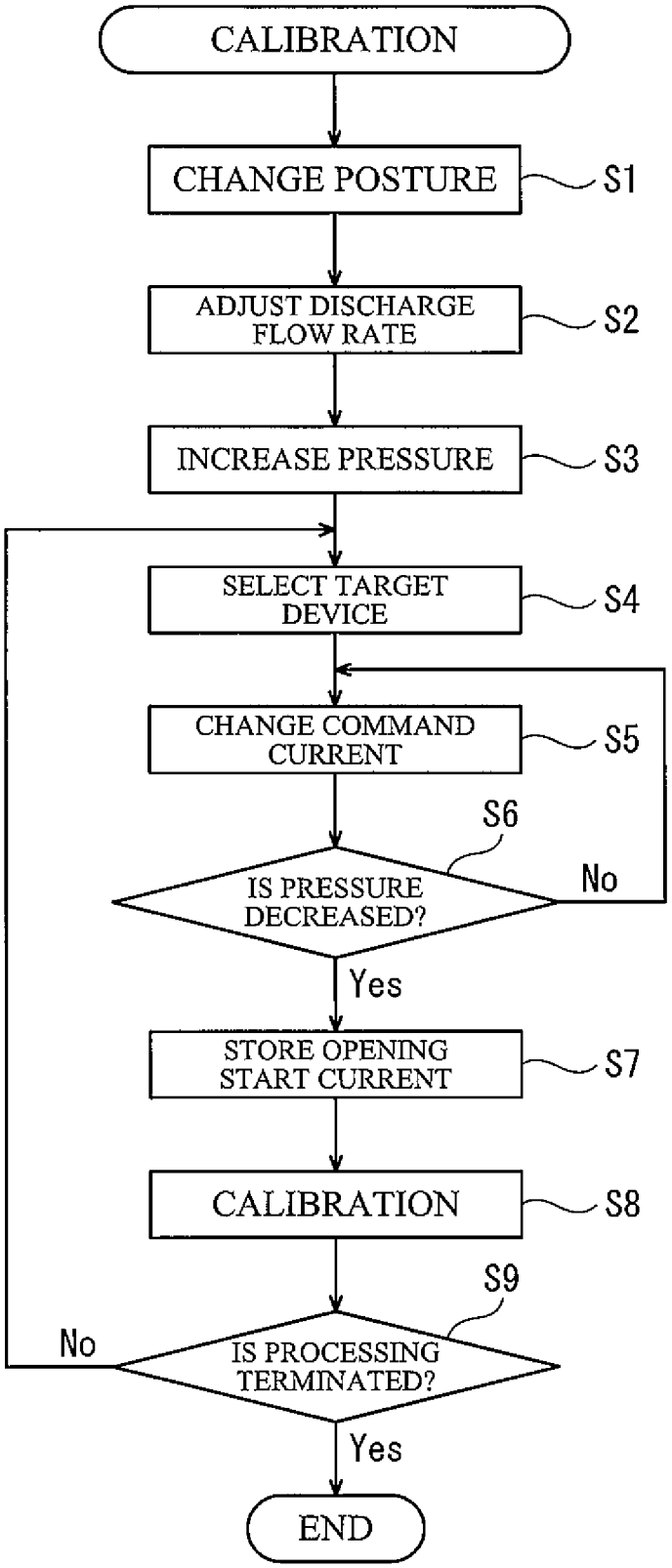
FIG. 3 is a flow chart showing a procedure of calibration in the hydraulic driving system shown in FIG. 2.

A mode instructing device 44 is electrically connected to the controller 30. The mode instructing device 44 is constituted by, for example, a switch and an operation panel. As with the operating levers 41*a* to 43*a*, to allow the driver to operate the mode instructing device 44, the mode instructing device 44 is arranged in the driver's cab 12*a*. The mode instructing device 44 is configured to be able to select a driving mode and a calibration mode. In the driving mode, the driver can operate the operating levers 41*a* to 43*a* to make the hydraulic cylinders 16 to 18 expand or contract, and as a result, make the bucket 15 move. In the calibration mode, the controller 30 executes calibration, i.e., the controller 30 performs calibration of movement start timings of the hydraulic cylinders 16 to 18 with respect to the operations of the operating levers 41*a* to 43*a*. To be specific, the controller 30 executes the calibration by a calibration instruction from the mode instructing device 44. Hereinafter, the calibration executed by the controller 30 will be described with reference to the flow chart of FIG. 3.

Calibration

When the calibration mode is selected by the mode instructing device 44 as described above, the controller 30 proceeds to Step S1 to execute the calibration. In Step S1 that is a posture changing step, the controller 30 controls the movements of various components to make a structure 19 take an initial posture as shown in FIG. 1. The structure 19 is constituted by the boom 13, the arm 14, and the bucket 15. To be specific, the controller 30 controls the movements of the three flow control valve devices 24 to 26 and the bleed-off valve 27 to make the boom cylinder 16, the arm cylinder 17, and the bucket cylinder 18 expand. More specifically, the controller 30 supplies the movement command currents to the first electromagnetic proportional valves 33R of the three flow control valve devices 24 to 26 to make rods 16*c*, 17*c*, and 18*c* of the boom cylinder 16, the arm cylinder 17, and the bucket cylinder 18 move until the rods 16*c*, 17*c*, and 18*c* reach their stroke ends (i.e., predetermined positions). With this, the structure 19 takes the initial posture. After the structure 19 takes the initial posture, the controller 30 proceeds from Step S1 to Step S2.

In Step S2 that is a discharge flow rate adjusting step, the discharge flow rate of the operating liquid discharged from the hydraulic pump 21 is adjusted to a predetermined flow rate or less. Herein, the predetermined flow rate is a flow rate that is equal to or less than a permissible flow rate of the relief valve 28. The present embodiment will describe a case where the discharge flow rate of the operating liquid discharged from the hydraulic pump 21 is adjusted to a minimum flow rate that is equal to or less than the permissible flow rate of the relief valve 28. To be specific, the controller 30 outputs the discharge flow rate command current to the regulator 21*b* to limit the discharge flow rate of the hydraulic pump 21 to the minimum flow rate. After the discharge flow rate is adjusted to the minimum flow rate, the controller 30 proceeds from Step S2 to Step S3.

In Step S3 that is a pressure increasing step, the supply and discharge of the operating liquid to and from the hydraulic cylinders 16 to 18 and the bleed-off of the operating liquid discharged from the hydraulic pump 21 are stopped. To be specific, the controller 30 stops the supply and discharge of the operating liquid to and from the hydraulic cylinders 16 to 18 by making the spools 31*a* of the flow control valves 31 of the three flow control valve devices 24 to 26 locate at the respective neutral positions M. Further, the controller 30 supplies the bleed-off command current to the bleed-off valve 27 to make the bleed-off valve 27 close the main passage 22. When the supply and discharge of the operating liquid to and from the hydraulic cylinders 16 to 18 and the bleed-off of the operating liquid are stopped as above, the discharge pressure increases to reach the relief pressure pr soon. Then, the relief valve 28 opens, and the operating liquid flowing through the main passage 22 is introduced to the tank 23. Thus, the discharge pressure is kept at the relief pressure pr. After the discharge pressure increases to reach the relief pressure pr as above, the controller 30 proceeds from Step S3 to Step S4.

In Step S4 that is a target device selecting step, a target device that is a device subjected to the calibration is selected from the three flow control valve devices 24 to 26 and the bleed-off valve 27. In the present embodiment, the boom flow control valve device 24 is first selected as the target device. After the target device is selected, the controller 30 proceeds from Step S4 to Step S5. In Step S5 that is a command current changing step, the controller 30 changes the command current supplied to the target device. To be specific, the controller 30 outputs the movement command current to the second electromagnetic proportional valve 33L of the boom flow control valve device 24. In the present embodiment, the rod 16*c* of the boom cylinder 16 is moved to the stroke end in Step S1, and therefore, the rod 16*c* can move only in such a direction that the boom cylinder 16 contracts. To be specific, the rod 16*c* can surely move in such a direction that the boom cylinder 16 contracts. Therefore, to move the rod 16*c* in such a direction that the boom cylinder 16 contracts, the controller 30 supplies the movement command current to the second electromagnetic proportional valve 33L. After the command current is supplied to the target device as above, the controller 30 proceeds from Step S5 to Step S6.

Figure 4A:
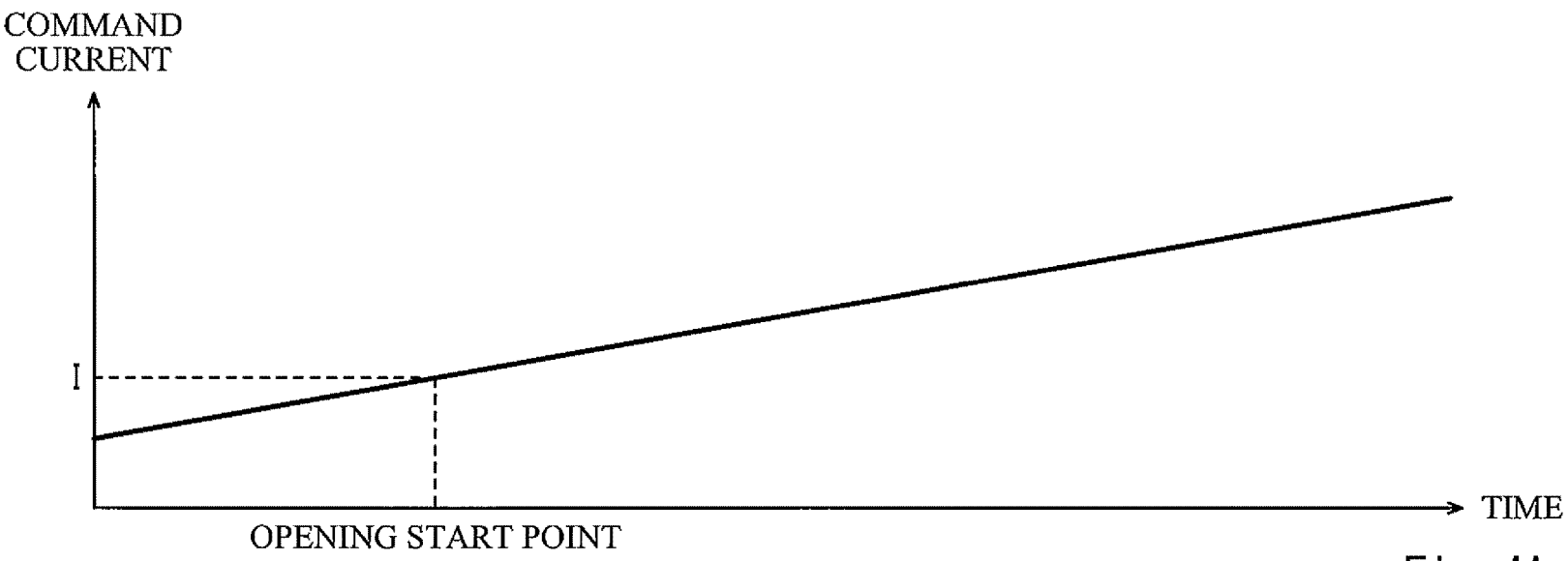
FIG. 4A is a graph showing a time-lapse change of a command current when the calibration is performed by the hydraulic driving system shown in FIG. 2.
Figure 4B:
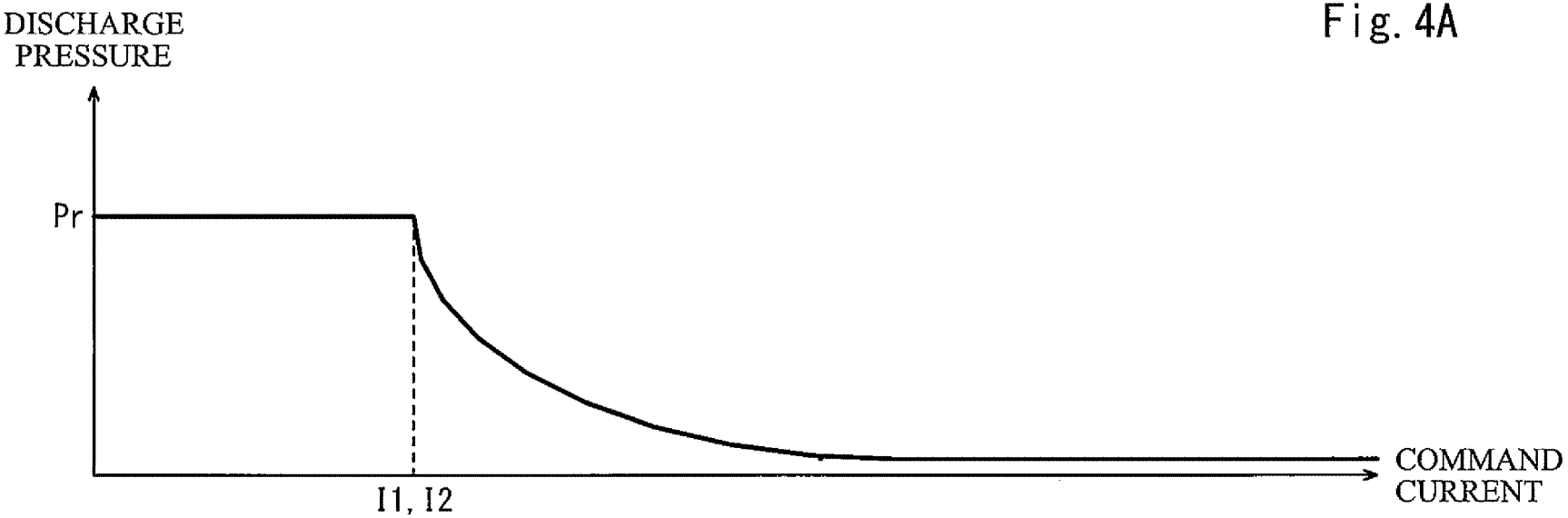
FIG. 4B is a graph showing a change in a discharge pressure with respect to the command current when the calibration is performed.

In Step S6 that is a pressure decrease determining step, the controller 30 determines whether or not the discharge pressure is decreased. To be specific, the controller 30 detects and stores the discharge pressure based on the signal supplied from the discharge pressure sensor 29 and compares the detected discharge pressure with the discharge pressure that is stored after being increased in the pressure increasing step of Step S3. Then, whether or not the discharge pressure is decreased is determined based on one example described below. To be specific, when the detected discharge pressure falls within a range set based on a predetermined percentage of the stored discharge pressure, the controller 30 determines that the discharge pressure is not decreased. In this case, the controller 30 returns from Step S6 to Step S5. In Step S5, the controller 30 increases the movement command current supplied to the second electromagnetic proportional valve 33L and proceeds from Step S5 to Step S6. Then, the controller 30 again compares the stored discharge pressure with the detected discharge pressure. Increasing the movement command current and comparing the stored discharge pressure with the detected discharge pressure are repeatedly performed until the controller 30 determines that the discharge pressure is decreased. Until then, as shown in a graph of FIG. 4A, the controller 30 gradually increases the movement command current output to the second electromagnetic proportional valve 33L. In FIG. 4A, a vertical axis denotes the movement command current, and a horizontal axis denotes a time. By gradually increasing the movement command current, the pilot pressure p2 output from the second electromagnetic proportional valve 33L gradually increases, and the supply passage 32 and the rod port 16*a* are connected to each other soon (opening start point in FIG. 4A). When the supply passage 32 and the rod port 16*a* are connected to each other, the operating liquid flowing through the main passage 22 flows to the boom cylinder 16, and as shown in FIG. 4B, the discharge pressure that is kept at the relief pressure pr is decreased. In FIG. 4B, a vertical axis denotes the discharge pressure, and a horizontal axis denotes the movement command current. When the discharge pressure is decreased, the discharge pressure detected based on the signal supplied from the discharge pressure sensor 29 is also decreased. Thus, the controller 30 determines that the discharge pressure is decreased. Then, the controller 30 proceeds from Step S6 to Step S7.

In Step S7 that is an opening start current storing step, the controller 30 stores the command current supplied when the discharge pressure starts being decreased, i.e., the controller 30 stores an opening start current I1 (first opening start current that is the movement command current at the opening start point at which a passage between the supply passage 32 and the rod port 16*a* starts being opened by the flow control valve 31). To be specific, the controller 30 stores, as the opening start current I1, the movement command current supplied to the second electromagnetic proportional valve 33L when the controller 30 determines that the discharge pressure is decreased. After the opening start current I1 is stored, the controller 30 proceeds from Step S7 to Step S8.

In Step S8 that is a calibration step, the controller 30 adjusts a correspondence relation between the operation amount of the operating lever 41*a* and the opening start current I1 based on the opening start current I1 stored in Step S7. To be specific, while maintaining the proportional relation between the operation amount and the movement command current, the controller 30 adds an offset value (corresponding to a differential current described below) to the proportional relation such that when the operation amount of the operating lever 41*a* becomes a predetermined amount, the opening start current I1 is output from the second electromagnetic proportional valve 33L. More specifically, when the operating lever 41*a* is operated by the predetermined amount before the correspondence relation is adjusted, the controller 30 compares the opening start current I1 with the movement command current supplied to the second electromagnetic proportional valve 33L and calculates the differential current obtained by subtracting the above movement command current from the opening start current I1. Then, the controller 30 performs offset of the proportional relation between the operation amount and the movement command current by the differential current such that when the operating lever 41*a* is operated by the predetermined amount, the passage between the supply passage 32 and the rod port 16*a* starts being opened, and the boom cylinder 16 starts moving. After the offset by the differential current is performed, and the calibration of the movement command current is performed as above, the controller 30 proceeds from Step S8 to Step S9.

In Step S9 that is a processing termination determining step, the controller 30 determines whether or not the calibration of the command current for all of the three flow control valve devices 24 to 26 and the bleed-off valve 27 is terminated. When the calibration of the command currents is not terminated, the controller 30 returns to Step S4 and selects the target device from the devices which are not subjected to the calibration. To be specific, when the arm flow control valve device 25 is selected, and the controller 30 proceeds to Step S5, the procedure including Steps S5 to S8 is executed as with when the boom flow control valve device 24 is selected. With this, regarding the boom flow control valve device 24, the offset of the proportional relation between the operation amount of the operating lever 42*a* and the movement command current by the differential current is performed, and the calibration of the movement command current is performed. After the calibration of the operation command for the arm flow control valve device 25 current is terminated, the controller 30 returns again from Step S9 to Step S4. Then, the bucket flow control valve device 26 is selected, and the controller 30 proceeds to Step S5.

As with when each of the boom flow control valve device 24 and the arm flow control valve device 25 is selected, the procedure including Steps S5 to S8 is executed for the bucket flow control valve device 26. With this, regarding the bucket flow control valve device 26, the offset of the proportional relation between the operation amount of the operating lever 43*a* and the movement command current by the differential current is performed, and the calibration of the movement command current is performed. After the calibration of the movement command current for the bucket flow control valve device 26 is terminated, the controller returns from Step S9 to Step S4. Finally, the bleed-off valve 27 is selected, and the controller 30 proceeds to Step S5.

Regarding the bleed-off valve 27, the calibration of the bleed-off command current is performed through a procedure that is substantially the same as each of the procedures for the three flow control valve devices 24 to 26. However, the procedure for the bleed-off valve 27 is slightly different due to reasons, such as the bleed-off valve 27 being a normally-open valve. To be specific, when the bleed-off valve 27 is selected, the controller 30 changes the bleed-off command current supplied to the bleed-off valve 27 as the target device, i.e., changes the bleed-off command current in Step S5. More specifically, the bleed-off command current is supplied to the bleed-off valve 27 to close the main passage 22. A relation between the operation amount and the bleed-off command current is an inversely proportional relation. Therefore, the controller 30 deceases the bleed-off command current in Step S5 to move the bleed-off valve 27 in such a direction that the bleed-off valve 27 opens the main passage 22. After the bleed-off command current is decreased as above, the controller 30 proceeds from Step S5 to Step S6.

In Step S6, as with when each of the flow control valve devices 24, 25, and 26 is selected, the controller 30 compares the stored discharge pressure with the detected discharge pressure and determines whether or not the discharge pressure is decreased. When the controller 30 determines that the discharge pressure is not decreased, the controller 30 returns to Step S5 and further decreases the bleed-off command current. When the controller 30 determines that the discharge pressure is decreased, the controller 30 proceeds to Step S7 and stores an opening start current I2 (second opening start current that is the bleed-off command current at the opening start point at which the main passage 22 starts being opened by the bleed-off valve 27). In Step S8, the calibration of the bleed-off command is performed based on the stored opening start current I2 such that when each of the operation amounts of the operating levers 41*a* to 43*a* becomes a predetermined amount, the opening start current I2 is supplied. After the calibration of the bleed-off command current for the bleed-off valve 27 is terminated as above, the controller 30 proceeds from Step S8 to Step S9. In Step S9, the controller 30 determines that the calibration of the command currents for all of the three flow control valve devices 24 to 26 and the bleed-off valve 27 is terminated. After the termination of the calibration, the controller 30 proceeds from the calibration mode to the driving mode.

In the hydraulic driving system 1 configured as above, the controller 30 performs the calibration. With this, even when the pressure sensors are not provided at the output sides of the three flow control valve devices 24 to 26 and the bleed-off valve 27, the movement start timings of the three flow control valve devices 24 to 26 and the bleed-off valve 27 with respect to the operations of the operating levers can be adjusted. With this, the movement start timings of the three flow control valve devices 24 to 26 and the bleed-off valve 27 with respect to the operations of the operating levers 41*a* to 43*a* can be made to match each other. Thus, the movement start timings of the three flow control valve devices 24 to 26 and the bleed-off valve 27 with respect to the operations of the operating levers can be prevented from varying. To be specific, when moving the boom 13, the arm 14, and the bucket 15, play (operation dead zones) of the operating levers 41*a* to 43*a* can be prevented from varying.

In the hydraulic driving system 1, the spools 31*a* of the flow control valves 31 are made to locate at the respective neutral positions M in Step S3, and with this, the passages between the hydraulic pump 21 and the hydraulic cylinders 16 to 18 are blocked. After that, the movement command currents are gradually increased in Step S5, and with this, the passages between the hydraulic pump 21 and the hydraulic cylinders 16 to 18 are opened. Thus, the discharge pressure kept at the relief pressure pr in Step S3 steeply decreases when the passages between the hydraulic pump 21 and the hydraulic cylinders 16 to 18 are opened in Step S5. Therefore, the controller 30 can easily determine that the passages between the hydraulic pump 21 and the hydraulic cylinders 16 to 18 are opened by the flow control valve devices 24 to 26 (i.e., that the flow control valve devices 24 to 26 open), and the detected opening start currents I1 can be prevented from varying. The same is true for the bleed-off valve 27.

Further, in the hydraulic driving system 1, the discharge flow rate of the hydraulic pump 21 when performing the calibration is limited to the minimum flow rate in Step S2. With this, a relief flow rate of the operating liquid exhausted from the relief valve 28 in Step S3 can be suppressed, and therefore, an excessive increase in the discharge pressure and an excessive temperature increase of the operating liquid can be suppressed. It is also possible to prevent a case where a large amount of operating liquid is wastefully exhausted from the relief valve 28, and this increases the energy loss. Further, since the discharge flow rate is decreased, the decrease in the discharge pressure when the passages between the hydraulic pump 21 and the hydraulic cylinders 16 to 18 are opened can be made steeper than when the discharge flow rate is high. Therefore, the controller 30 can easily determine that the passages between the hydraulic pump 21 and the hydraulic cylinders 16 to 18 are opened by the flow control valve devices 24 to 26, and the detected opening start currents I1 can be prevented from varying. The same is true for the bleed-off valve 27.

In the hydraulic excavator 2, loads acting on the respective hydraulic cylinders 16 to 18 change depending on the posture of the structure 19, and the discharge pressure detected when opening the passages between the hydraulic pump 21 and the hydraulic cylinders 16 to 18 changes for every posture of the structure 19. Therefore, when performing the calibration in different postures, the loads acting on the respective rods 16*c* to 18*c* differ between these postures, and these loads may influence the detection of the opening start currents I1. Therefore, in the hydraulic driving system 1, after the structure 19 is made to take the initial posture in Step S1, the calibration of the command current is performed. To be specific, the calibration is performed in the same posture. With this, the influence by the changes in the loads can be suppressed, and the detected opening start currents I1 can be prevented from varying.

In the initial posture taken by the structure 19 in Step S1, the rods 16*c* to 18*c* of the hydraulic cylinders 16 to 18 are moved to the respective stroke ends, and the rods 16*c* to 18*c* can move therefrom in only one direction (i.e., a movable direction). Therefore, it is possible to prevent a case where while executing the calibration, the rods 16*c* to 18*c* reach the respective stroke ends, and the operating liquid cannot be supplied to the hydraulic cylinders 16 to 18. To be specific, it is possible to prevent a case where the rods 16*c* to 18*c* reach the respective stroke ends, and the opening start currents I1 cannot be detected. Therefore, the movement start timings of the flow control valve devices with respect to the operations of the operating levers 41*a* to 43*a* can be adjusted without providing, for example, sensors configured to detect the positions of the rods 16*c* to 18*c*.

Further, in the hydraulic driving system 1, the calibration mode is selected by the mode instructing device 44, i.e., the calibration is executed after the execution of the calibration is instructed. Therefore, the calibration can be prevented from being undesirably performed during, for example, driving.

Embodiment 2

The hydraulic driving system 1A of Embodiment 2 is similar in configuration to the hydraulic driving system 1 of Embodiment 1. Therefore, components of the hydraulic driving system 1A of Embodiment 2 which are different from the components of the hydraulic driving system 1 of Embodiment 1 will be mainly described. The same reference signs are used for the same components, and a repetition of the same explanation is avoided.

Figure 5:
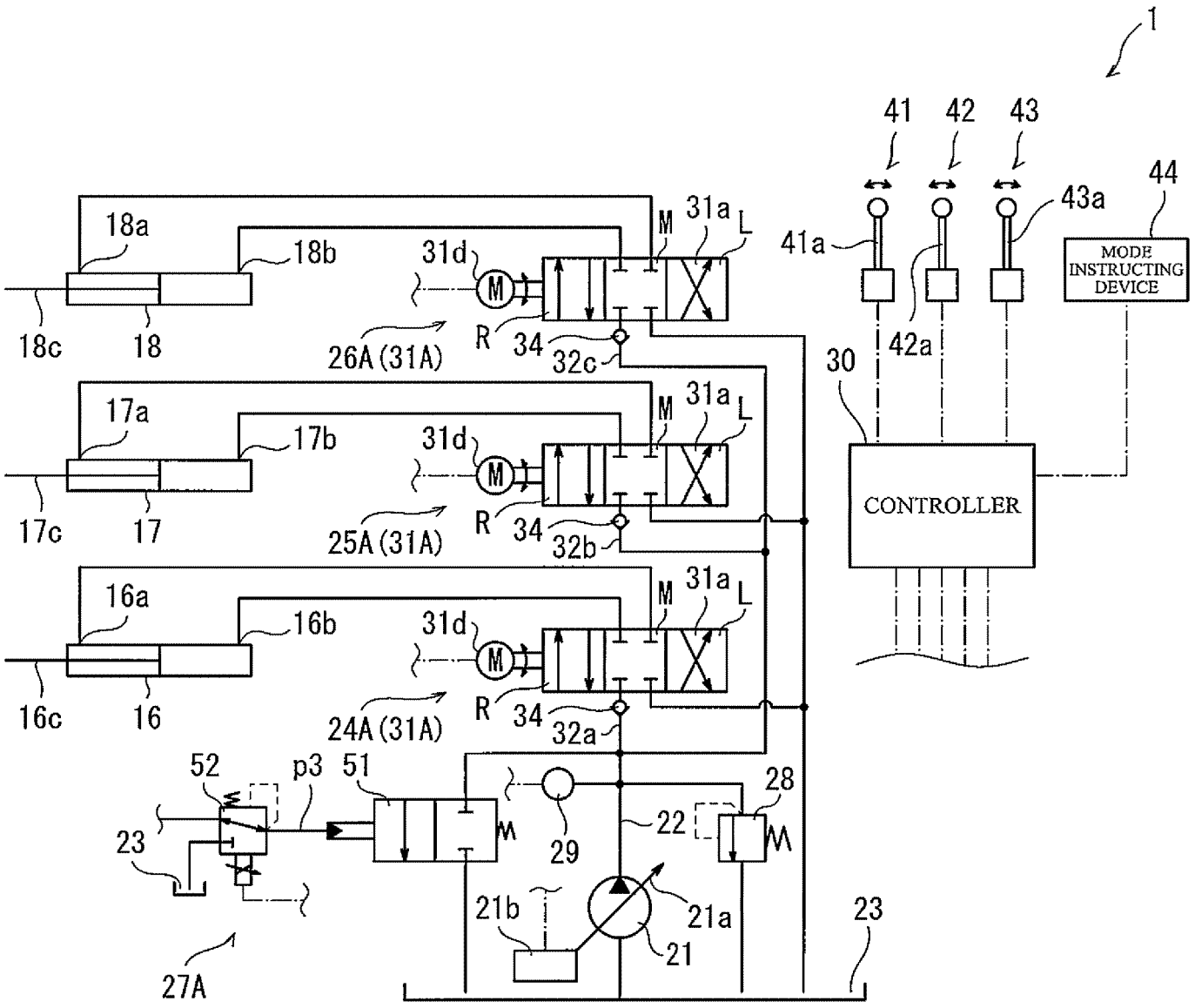
FIG. 5 is a circuit diagram showing a hydraulic circuit of the hydraulic driving system according to Embodiment 2.

As shown in FIG. 5, the hydraulic driving system 1A of Embodiment 2 includes the hydraulic pump 21, three flow control valve devices 24A to 26A, a bleed-off valve device 27A, the relief valve 28, the discharge pressure sensor 29, the controller 30, the three operating devices 41 to 43, and the mode instructing device 44. The three flow control valve devices 24A to 26A are connected in parallel to the hydraulic pump 21. To be specific, a downstream part of the main passage 22 branches into three supply passages 32*a*, 32*b*, and 32*c*, and the supply passages 32*a*, 32*b*, and 32*c* are connected to the corresponding flow control valve devices 24A, 25A, and 26A through the corresponding check valves 34.

Each of the three flow control valve devices 24A to 26A connected as above is constituted by an electric spool valve 31A. The electric spool valve 31A includes the spool 31*a* and an electric actuator 31*d*. The electric actuator 31*d* is constituted by, for example, an electric motor and a ball screw. The electric motor rotates in one direction or the other direction in accordance with a drive command current output from the controller 30. The spool 31*a* is coupled to the electric motor through the ball screw. When the electric motor rotates in one direction, the spool 31*a* moves to the first offset position R. When the electric motor rotates in the other direction, the spool 31*a* moves to the second offset position L. The spool 31*a* does not have a function of opening and closing the main passage 22. However, regarding the function of adjusting the opening degrees between the supply passage (32*a*, 32*b*, 32*c*) and the hydraulic cylinder (16, 17, 18) and between the tank 23 and the hydraulic cylinder (16, 17, 18), the spool 31*a* of Embodiment 2 is the same as the spool 31*a* of Embodiment 1. Therefore, the flow control valve device (24A, 25A, 26A) opens the passage between the hydraulic pump 21 and the hydraulic cylinder (16, 17, 18) by the opening degree corresponding to the drive command current output from the controller 30.

The hydraulic driving system 1A is constituted by a concentration bleed type hydraulic control circuit. The bleed-off valve device 27A is connected to the main passage 22. The bleed-off valve device 27A includes a bleed-off valve 51 and an electromagnetic proportional control valve 52. The bleed-off valve 51 is a pilot type and normally closed valve. The bleed-off valve 51 performs the bleed-off, i.e., exhausts the operating liquid from the main passage 22 at the flow rate corresponding to a pilot pressure p3 input to the bleed-off valve 51. The electromagnetic proportional control valve 52 is a so-called inversely proportional valve. The electromagnetic proportional control valve 52 is connected to a pilot pump (not shown) and outputs to the bleed-off valve 51 the pilot pressure p3 that is a pressure corresponding to the bleed-off command current input to the electromagnetic proportional control valve 52. As with the bleed-off valve 27 of Embodiment 1, the bleed-off valve device 27A configured as above performs the bleed-off, i.e., exhausts the operating liquid from the main passage 22 at the flow rate corresponding to the bleed-off command current.

In the hydraulic driving system 1A configured as above, when the calibration mode is selected by the mode instructing device 44, the controller 30 performs the same calibration as the hydraulic driving system 1 of Embodiment 1 to perform the calibration of the drive command current and the bleed-off command current. Regarding the calibration of the hydraulic driving system 1A, the calibration of the hydraulic driving system 1 of Embodiment 1 can be referred to, and a detailed explanation thereof is omitted.

The hydraulic driving system 1A configured as above has the same operational advantages as the hydraulic driving system 1 of Embodiment 1.

Other Embodiments

In Step S5 in the calibration of the present embodiment, the movement command currents are supplied to the flow control valve devices 24 to 26 such that the hydraulic cylinders 16 to 18 are moved in respective expanding directions from respective stop states, and then, the calibration is performed. However, even when the hydraulic cylinders 16 to 18 are moved in respective contracting directions from the respective stop states, the calibration can be performed. Further, even when the hydraulic cylinders 16 to 18 are stopped in a state where the hydraulic cylinders 16 to 18 are moving in the respective expanding directions or even when the hydraulic cylinders 16 to 18 are stopped in a state where the hydraulic cylinders 16 to 18 are moving in the respective contracting directions, the calibration can be performed. For example, in the calibration performed when the hydraulic cylinders 16 to 18 are stopped in a state where the hydraulic cylinders 16 to 18 are moving in the respective contracting directions, the movement command currents supplied to the flow control valves 31 are decreased such that the flow control valves 31 move in respective closing directions in a state where the passages between the supply passage 32 and the rod ports 16*a* to 18*a* are in respective open states. In this case, when the discharge pressure detected based on the discharge pressure sensor 29 increases to reach the relief pressure pr, the closing between the supply passage 32 and the rod ports 16*a* to 18*a* (i.e., a closing completion point) can be detected. Then, a closing completion current can be calculated based on the movement command current at the time of the closing. Further, by adjusting a correspondence relation between the operation amount of the operating lever 41*a* and the closing completion current based on the obtained closing completion current, the movement completion timing of the flow control valve device (24, 25, 26, 24A, 25A, 26A) can be adjusted.

As with the above, regarding the bleed-off valve 27 and the bleed-off valve device 27A, the closing completion current can be calculated, and the above correspondence relation can be adjusted. Thus, the same operational advantages as above can be obtained.

In the hydraulic driving systems 1 and 1A of Embodiments 1 and 2, the operating devices 41 to 43 are constituted by the electric joysticks but are not necessarily limited to these. To be specific, the operating devices 41 to 43 may be hydraulic pilot type operating devices. In this case, by detecting the output pressure from the operating valve by, for example, a pressure sensor, the operation directions and operation amounts of the operating levers 41*a* to 43*a* can be detected. Further, in the hydraulic driving systems 1 and 1A of Embodiments 1 and 2, the flow control valves 31 and the electric spool valves 31A are configured to drive in accordance with the command signals but may be pilot type flow control valves. In this case, the calibration cannot be performed for the flow control valves 31 and the electric spool valves 31A, but the calibration of the bleed-off command current can be performed by the above-described calibration.

Further, in the hydraulic driving systems 1 and 1A of Embodiments 1 and 2, the structure 19 of the hydraulic excavator 2 is made to take the initial posture when the calibration is performed. However, the structure 19 does not necessarily have to be made to take the initial posture. In addition, the structure 19 does not have to be made to take a predetermined posture for every calibration. Furthermore, in the hydraulic driving systems 1 and 1A of Embodiments 1 and 2, each of the hydraulic cylinders 16 to 18 is described as one example of the hydraulic actuator, but the hydraulic actuator may be a hydraulic motor included in the travelling device 11 or the turning body 12.

Further, in the hydraulic driving systems 1 and 1A of Embodiments 1 and 2, the pressure sensors are not provided at the output sides of the valve devices. However, the pressure sensors may be provided. To be specific, even if the pressure sensors are provided, the calibration of the movement command current and the bleed-off command current is only required to be performed by the above-described calibration without using the detection results of the pressure sensors.

REFERENCE SIGNS LIST

1, 1A hydraulic driving system
16 boom cylinder (hydraulic actuator and hydraulic cylinder)
17 arm cylinder (hydraulic actuator and hydraulic cylinder)
18 bucket cylinder (hydraulic actuator and hydraulic cylinder)
19 structure
21 hydraulic pump
21*a* swash plate
21*b* regulator
24, 24A boom flow control valve device
25, 25A arm flow control valve device
26, 26A bucket flow control valve device
27 bleed-off valve (bleed-off valve device)
27A bleed-off valve device
28 relief valve
29 discharge pressure sensor
30 controller
41*a* to 43*a* operating lever (operating element)
44 mode instructing device

The invention claimed is:

1. A hydraulic driving system comprising:

a flow control valve device interposed between a hydraulic pump and a hydraulic actuator configured to be driven by an operating liquid discharged from the hydraulic pump, the flow control valve device being configured to adjust an opening degree between the hydraulic pump and the hydraulic actuator in accordance with a movement command current to control a flow rate of the operating liquid discharged from the hydraulic pump, the movement command current being supplied to the flow control valve device;

a bleed-off valve device interposed between the hydraulic pump and a tank and configured to adjust an opening degree between the hydraulic pump and the tank to control the flow rate at which bleed-off of the operating liquid is performed;

a discharge pressure sensor configured to detect a discharge pressure of the hydraulic pump;

a relief valve configured to, when the discharge pressure of the hydraulic pump becomes a relief pressure or more, exhaust to the tank the operating liquid discharged from the hydraulic pump;

an operating element configured to be operated for driving the hydraulic actuator; and a controller configured to control a movement of the flow control valve device by supplying to the flow control valve device the movement command current corresponding to an operation amount of the operating element and also configured to control a movement of the bleed-off valve device, wherein the controller executes calibration in which:

in a state where the bleed-off valve device blocks between the hydraulic pump and the tank, the controller changes the movement command current supplied to the flow control valve device and makes the discharge pressure sensor detect the discharge pressure;

based on the detected discharge pressure and the relief pressure, the controller detects at least one of an opening start current that is a current when the flow control valve device starts opening and a closing completion current that is a current when closing of the flow control valve device is completed; and based on the detected at least one current, the controller adjusts a correspondence relation between the operation amount of the operating element and the at least one current.

2. The hydraulic driving system according to claim 1, wherein when changing the movement command current supplied to the flow control valve device to detect the opening start current in the calibration, the controller makes the flow control valve device block between the hydraulic pump and the hydraulic actuator, and then, changes the movement command current so as to open between the hydraulic pump and the hydraulic actuator.

3. The hydraulic driving system according to claim 1, wherein:

the controller controls a displacement of a variable displacement pump that is the hydraulic pump; and in the calibration, the controller sets a discharge flow rate of the hydraulic pump to a predetermined flow rate or less.

4. The hydraulic driving system according to claim 1, wherein before the controller executes the calibration, the controller supplies the operating liquid through the flow control valve device to a hydraulic cylinder, which is the hydraulic actuator, to make a rod of the hydraulic cylinder move to a predetermined position.

5. The hydraulic driving system according to claim 4, wherein:

the controller controls the movement of the flow control valve device to make the rod of the hydraulic cylinder move to a stroke end that is the predetermined position; and in order that the operating liquid flows through the flow control valve device in such a direction that the rod of the hydraulic cylinder moves, the controller changes the movement command current supplied to the flow control valve device.

6. The hydraulic driving system according to claim 1, further comprising an instructing device configured to instruct an execution of the calibration, wherein based on the instruction of the execution of the calibration from the instructing device, the controller executes the calibration.

7. The hydraulic driving system according to claim 1, wherein the controller executes the calibration including:

a first processing in which the controller detects a first opening start current that is the opening start current, and the controller adjusts a correspondence relation between the operation amount of the operating element and the first opening start current; and a second processing in which the controller makes the discharge pressure sensor detect the discharge pressure while changing the bleed-off command current supplied to the bleed-off valve device, based on the detected discharge pressure and the relief pressure, the controller detects a second opening start current that is a current when the bleed-off valve device starts opening, and based on the detected second opening start current, the controller adjusts a correspondence relation between the operation amount of the operating element and the second opening start current.

8. The hydraulic driving system according to claim 1, wherein the controller executes the calibration including:

a first processing in which the controller detects a first closing completion current that is the closing completion current, and the controller adjusts a correspondence relation between the operation amount of the operating element and the first closing completion current; and a second processing in which the controller makes the discharge pressure sensor detect the discharge pressure while changing the bleed-off command current supplied to the bleed-off valve device, based on the detected discharge pressure and the relief pressure, the controller detects a second closing completion current that is a current when closing of the bleed-off valve device is completed, and based on the detected second closing completion current, the controller adjusts a correspondence relation between the operation amount of the operating element and the second closing completion current.

9. A hydraulic driving system comprising:

a bleed-off valve device interposed between a tank and a hydraulic pump configured to supply an operating liquid to a hydraulic actuator, the bleed-off valve device being configured to adjust an opening degree between the hydraulic pump and the tank in accordance with a bleed-off command current to control a flow rate at which bleed-off of the operating liquid discharged from the hydraulic pump is performed, the bleed-off command current being supplied to the bleed-off valve device;

a discharge pressure sensor configured to detect a discharge pressure of the hydraulic pump;

a relief valve configured to, when the discharge pressure of the hydraulic pump becomes a relief pressure or more, exhaust to the tank the operating liquid discharged from the hydraulic pump;

an operating element configured to be operated for driving the hydraulic actuator; and a controller configured to control a movement of the bleed-off valve device by supplying to the bleed-off valve device the bleed-off command current corresponding to an operation amount of the operating element, wherein the controller executes calibration in which:

the controller makes the discharge pressure sensor detect the discharge pressure while changing the bleed-off command current supplied to the bleed-off valve device;

based on the detected discharge pressure and the relief pressure, the controller detects at least one of an opening start current that is a current when the bleed-off valve device starts opening and a closing completion current that is a current when closing of the bleed-off valve device is completed; and based on the detected at least one current, the controller adjusts a correspondence relation between the operation amount of the operating element and the at least one current.

* * * * *